United States Patent [19]

Klygis

[11] 3,985,228

[45] Oct. 12, 1976

[54] BOTTLE CARRIER

[75] Inventor: Mindaugas Julius Klygis, Barrington, Ill.

[73] Assignee: Illinois Tool Works Inc., Chicago, Ill.

[22] Filed: July 14, 1975

[21] Appl. No.: 595,944

[52] U.S. Cl. ..... 206/158; 206/199; 294/87.2

[51] Int. Cl.[2] ..... B65D 75/00; B66C 1/10

[58] Field of Search ..... 284/87.2, 87.26; 206/145–161, 294, 427–435; 229/40

[56] References Cited

UNITED STATES PATENTS

| | | | |
|---|---|---|---|
| 3,097,010 | 7/1963 | Silver | 206/158 |
| 3,387,879 | 6/1968 | Wood | 206/158 |
| 3,784,246 | 1/1974 | Klygis | 294/87.2 |

*Primary Examiner*—William Price
*Assistant Examiner*—Douglas B. Farrow
*Attorney, Agent, or Firm*—E. L. Benno; R. W. Beart

[57] ABSTRACT

A packaged linear array of bottles or like containers having reduced neck portions with applied caps, and including a carrier of sheet plastic material having side walls diverging downwardly from an apical fold line interrupted by longitudinally spaced openings receiving the inserted neck portions with edge portions of the openings in supporting engagement beneath outward annular shoulder means as provided by the closure caps or by outward rib means on the containers below the ends of the neck portions, and further including longitudinally spaced strap elements connecting the lower edges of the side walls substantially between adjacent openings and contoured to engage adjacent surface portions of containers inserted in the carrier for stable transport and handling of the package.

9 Claims, 5 Drawing Figures

BOTTLE CARRIER

BACKGROUND OF THE INVENTION

The invention relates to packages of bottles and like containers and carriers therefor. Such bottles or like containers are of the type including a reduced neck portion above the body portion. The neck portions may be closed with various forms of caps, such as screw caps or pressed-on caps, and in these forms, the lower edge of the cap presents an annular outward shoulder. In other forms of bottles and like containers, there is often provided an outward annular bead below the end of the neck portion and in this type of container, this bead may provide the outward shoulder. There are various forms of carriers for these types of bottles or containers, such as those made from sheet plastic material, cardboard and the like, which may in flat sheet form or folded to tubular and other shapes with upper openings to supportingly engage beneath the neck shoulder means as provided by the depending skirt edges of the container caps or by the neck bead as the case may be. The containers may be variously arranged in package form according to the carrier configuration. Thus, the containers may be arranged in parallel rows as in a six pack or in single line array, or even circular.

SUMMARY OF THE INVENTION

According to the present invention, the carrier is particularly designed for packaging the containers in linear array as, for example, three containers in a single row but the number of containers may vary. The carrier is one-piece and formed from a sheet of resilient plastic sheet material such as high density polyethylene or similar material, which is stamped from a flat sheet blank to provide a central body portion with a central fold line and spaced tabs or strap segments projecting laterally from the edges thereof. The blank is folded along the central fold line to provide side walls diverging downwardly therefrom and with the tabs or strap segments connected to form complete strap elements connecting the lower edges of the side walls. Neck receiving openings are spaced along the fold line and hand grip apertures are provided in the side walls. The cut out material may be recycled.

An object of the invention is to provide a carrier of the above type for a linear array of bottles or like containers which is of sufficient resiliency to facilitate assembly with the containers by pressing the same downwardly over the neck portions with edges of the openings snapping beneath the shoulder means on the containers and with the strap portions engaging container surfaces therebelow to resiliently stress the side walls with resultant urging of the edges of the openings into engagement with the shoulder means to provide a firm stable package.

Another object of the invention is to provide a carrier and package of the above type wherein the neck receiving openings are shaped to facilitate removal of the end and intermediate containers from the package.

A further object of the invention is to provide a carrier and package of the above type wherein the strap elements are connected intermediate the lengths thereof to engage adjacent surfaces of the included containers to assist in the stability of the package with the resiliency thereof facilitating removal of the containers from the package.

The above and other objects of the invention will in part be obvious and will be hereinafter more fully pointed out in the detail description of the accompanying drawings in which, FIG. 1 is a plan view of the blank from which the carrier is formed;

DETAILED DESCRIPTION OF THE PREFERRED EMBODIMENTS

Figure 1:
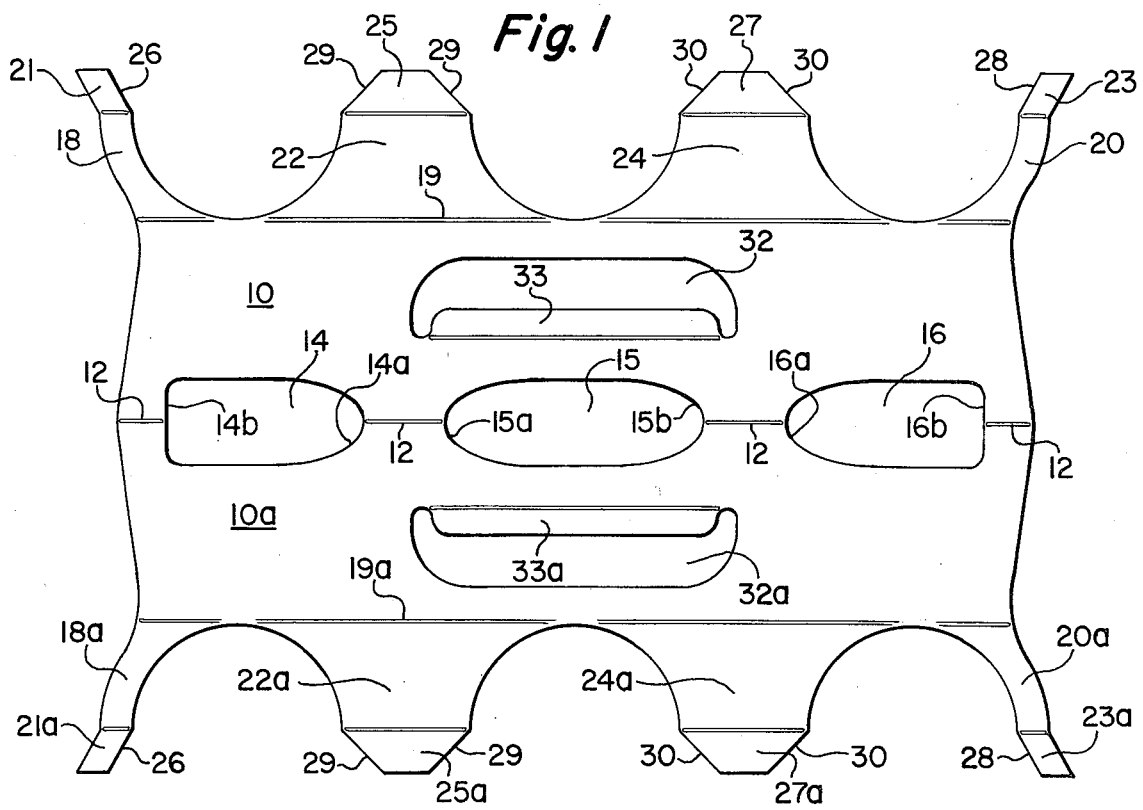

Referring to the accompanying drawings, and particularly FIG. 1 at this time, the carrier blank is shown before the formation thereof into the carrier for packaging. In this condition, the blanks may be packaged for shipment and storage. There are two side walls **10, 10*a* to opposite sides of a central fold line 12 which is interrupted therealong by cut-outs at opposite sides thereof providing elongate end openings 14, 16 and an elongate intermediate opening 15. The adjacent ends of the openings 14, 15 and 16 are rounded as at 14*a*, 15*a*, 15*b*, 16*a*, respectively, and the opposite ends 14*b*, 16*b* of the openings 14, 16, respectively, cross the fold line 12 at generally right angles thereto. Opposite edges of the side walls 10, 10*a* remote from the center fold line 12 are defined in part by interrupted fold lines 19, 19*a* from sections of which extend end strap segments in the form of strip-like arms 18, 18*a* and 20, 20*a*. Pairs of strap segments in the form of generally wedge-shaped arms 22, 22*a* and 24, 24*a* are disposed between the end strap segments and extend from intermediate sections of the interrupted fold lines 19, 19*a*. The adjacent edges of the intermediate arms, as well as those edges thereof adjacent the inner edges of the end arms, are complementally curved or otherwise contoured to engage adjacent surfaces of containers in the package as will be hereinafter pointed out. The ends of the strap segments 18, 18*a* and 20, 20*a* terminate in tabs 21, 21*a*, 23, 23*a*, respectively, to be folded along crease lines as will be hereinafter described. Similarly, the strap segments 22, 22*a* and 24, 24*a* are provided with end tabs 25, 25*a* and 27, 27*a*, respectively, to be similarly folded along crease lines as will be hereinafter described. The inner edges 26 and 28 of the end tabs 21, 21*a* and 23, 23*a*, respectively, are inclined outwardly. The opposite edges 29 and 30 of the intermediate tabs are inclined toward one another approaching the free ends of the tabs. The side walls 10, 10*a* may be provided with finger openings 32, 32*a* and adjacent foldable grip flaps 33, 33*a*** for transport of the carrier and containers when in package form.

Figure 2:
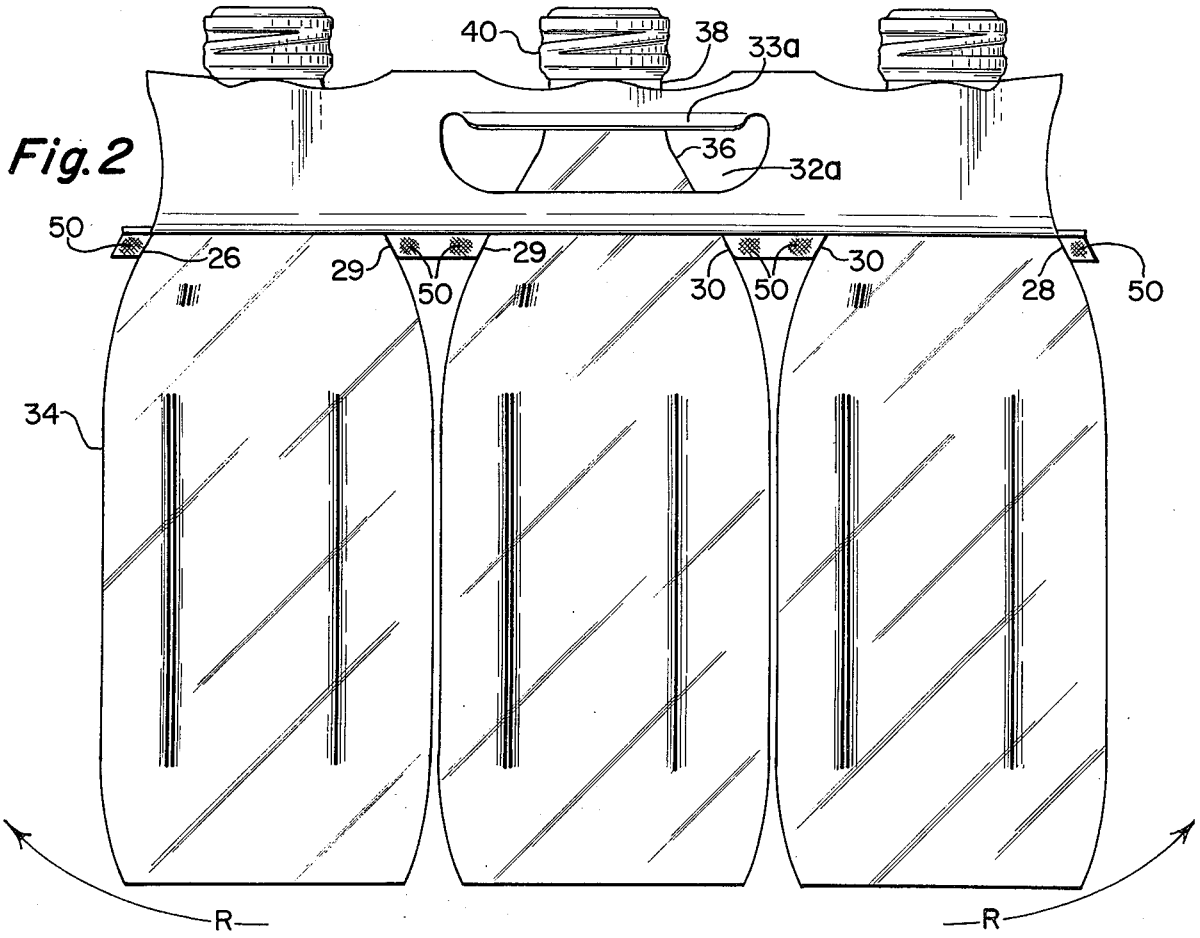
FIG. 2 is a side elevation of the formed carrier with the containers associated therewith as a package.
Figure 3:
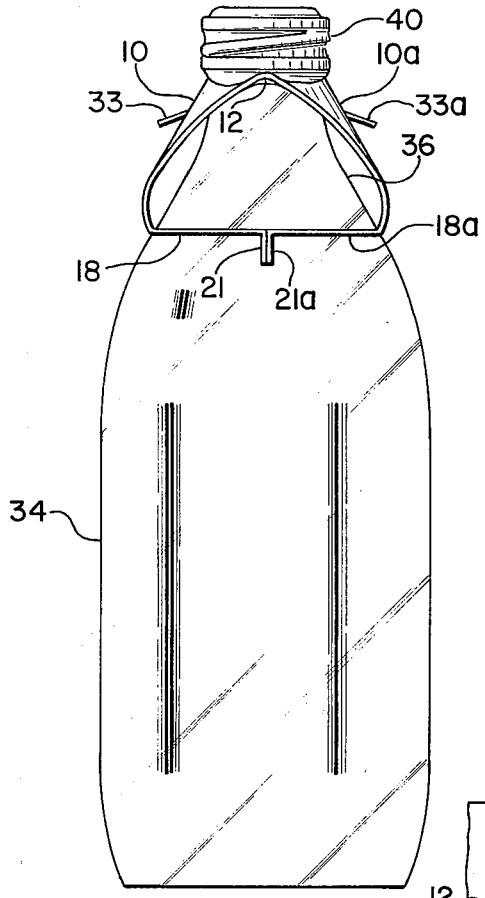
FIG. 3 is an end view of FIG. 2.
Figure 4:
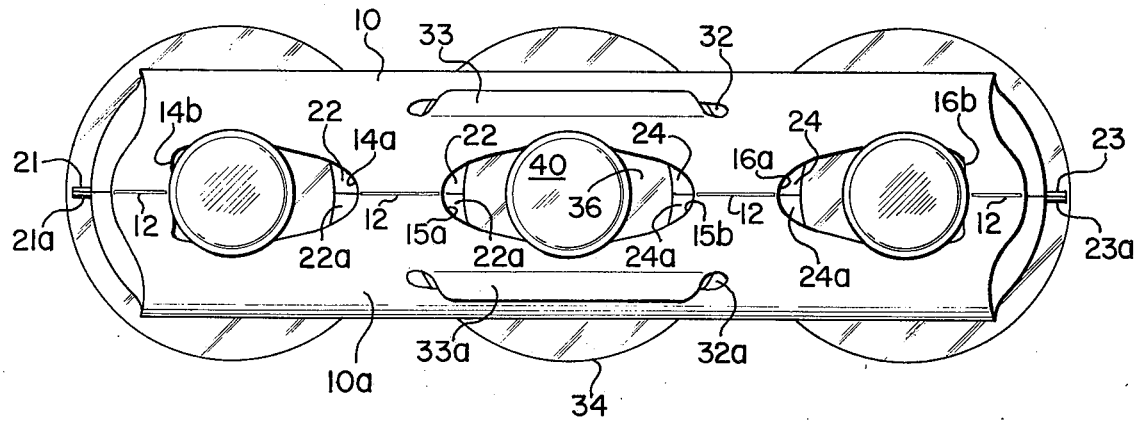
FIG. 4 is a top plan view of FIG. 2.

The carrier is designed for packaging a linear array of bottles or like containers and three such containers are shown in FIGS. 2, 3 and 4 in the form of bottles having body portions 34 tapering inwardly as at 36 to reduced neck portions 38 which may be externally threaded to receive screw caps 40. Other forms of caps may be used as closures and the containers may be of types having an annular shoulder below the neck extremity to provide carrier engaged shoulder means, as do the lower edges of screw caps, pressed caps and the like. In forming the carrier from the blank of FIG. 1, the side walls **10, 10*a* are folded downwardly along the fold line 12 to diverge therefrom. The strap segments 18, 18*a*, 20,**

20*a*, 22, 22*a*, 24, 24*a* are folded inwardly along the fold lines 19, 19*a* to position the tabs at the ends of the various strap segments in position for securing the same together by riveting, stapling, stitching or heat sealing in lapped positions or in vertically oriented face-to-face engagement, as illustrated, to connect the lower edges of the side walls. Thus, as particularly shown in FIG. 2, the tabs 21, 21*a* are brought together in face-to-face contact vertically beneath the apical fold line 12, as are the tabs 25, 25*a*, 27, 27*a*, 23, 23*a*, and secured as by heat sealing at the spot welds 50.

With the carrier so assembled, it is positioned over the linear array of bottles and pressed downwardly to telescope over the neck portions 38 of the bottles until the opposite longitudinal edges of the openings 14, 15, 16 snap beneath the shoulder means provided by the bottom skirt edges of the caps 40 of associated bottles. The edges 14*b* and 16*b* of the openings 14, 16, respectively, will similarly snap beneath adjacent edges of the caps as shown in FIGS. 2, 3 and 4. The resiliency of the carrier plastic material permits this application of the carrier to the bottle array and assists in maintaining a stable package as by engagement of the edges of the joined strap segments, as complete strap elements, with the adjacent surfaces 36 of the bottles below the neck portions. In this resilient engagement, the side walls will be resiliently bowed outwardly, as shown in FIG. 3, for stability by the engagement of the opening edges with the cap skirts and the engagement of the strap edges with the surfaces of the included bottles. For additional stability and resistance to canting of the packaged bottles, it should be noted that the inclined edges 26, 29, 30 and 28 of the tabs snug the adjacent surfaces 36 of the bottles above the body portions thereof.

Figure 5:
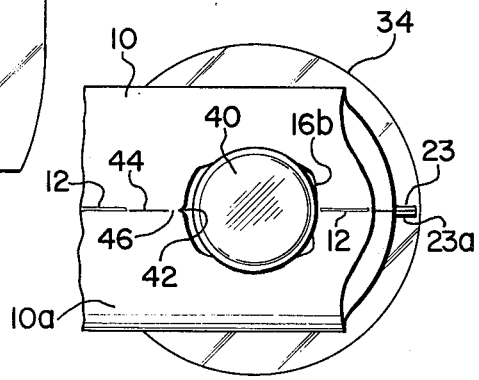
FIG. 5 is a fragmentary top plan view showing a modified form of neck-receiving opening.

A modified form of neck receiving opening is shown fragmentarily in FIG. 5, it being understood that such opening will be repeated in mirror image at the opposite end opening and at both ends of the intermediate opening. In this form of opening, the normally rounded end is replaced by an outwardly indented edge 42 separated from a slit 44 by a frangible web 46. In removing bottles from either form of opening, the end bottles are pulled outwardly and upwardly, as shown by the arrows R in FIG. 2, to cause the cap edges to pass through the portions 14*a*, 16*a* of the openings 14, 16, respectively, and the center bottle may be similarly moved in either direction for the cap to be urged through either end portion 15*a* or 15*b* of the opening 15. Similar movement of the bottles from the modified form of opening shown in FIG. 5 will result in the cap skirt rupturing the frangible web 46 to communicate with the slit 44 and facilitate removal of the bottles. The resiliency of the strap elements facilitates removal of the bottles as they may be deformed out of normal packaged position for this purpose.

I claim:

1. A package of a linear array of closely spaced bottles or like containers each having a reduced neck portion receiving a closure cap and presenting annular outward shoulder means below the upper extremity of the neck portion, and including a sheet plastic carrier having a pair of side walls diverging downwardly from a longitudinal apical fold line which is interrupted by spaced openings with at least opposite edge portions thereof in supporting underlying engagement with the shoulder means of inserted container neck portions, and strap elements integrally formed on and spaced along the bottom edges of each of the side walls, said strap elements extending substantially horizontally from the bottom edges of each of the side walls to a vertical plane including the said fold line and the free ends of opposed strap elements being folded vertically downwardly in said plane in face-to-face joined engagement, the edges of said strap elements being contoured to engage the included container surfaces below the shoulder means in said package, and the vertical edges of the joined free ends of said strap elements being contoured to engage the surfaces of adjacent containers in said package to resist canting thereof in said package longitudinally of said carrier.

2. A package as claimed in claim 1, wherein said openings are elongate along the apical line with adjacent ends rounded to facilitate removal of end containers by outward and upward swinging movement thereof and removal of an intermediate container by swinging movement thereof in either direction and upwardly.

3. A package as claimed in claim 1, wherein the side walls are provided with finger grip apertures adjacent a central neck receiving opening for transport and handling.

4. A package as claimed in claim 1, wherein the carrier is formed of resilient plastic material with the edge portions of the openings engaging the shoulder means and the contoured edges of the strap elements engaging the adjacent container surfaces in relative positions such as to outwardly bow the side walls under stress to maintain stability of the package.

5. A carrier for a linear array of closely spaced bottles or like containers each having a reduced neck portion receiving a closure cap and presenting annular outward shoulder means below the upper extremity of the neck portion, said carrier being formed from a sheet of plastics material and comprising a pair of side walls diverging downwardly from a longitudinal apical fold line which is interrupted by spaced openings, at least the opposite edge portions of said spaced openings which extend longitudinally of said carrier being spaced apart a distance capable of producing firm gripping and support of said opposite edge portions with the neck portions of said bottles when said bottles are inserted therethrough with said shoulder means above said openings, strap elements integrally formed on and spaced along the bottom edges of each of said side walls, said strap elements extending substantially horizontally from the bottom edges of each of the side walls to a vertical plane including said fold line and the free ends of opposed strap elements being folded vertically downwardly in said plane in face-to-face joined engagement, the edges of said strap elements being contoured to engage the included surfaces of said containers below the shoulder means when said bottles are inserted through said openings with the opposite edge portions of said openings below said outward shoulder means, and the vertical edges of the joined free ends of said strap elements being contoured to engage the surfaces of adjacent containers when inserted through said openings with the outward shoulder means above said openings to resist canting of such bottles relative to said carrier longitudinally of said carrier.

6. A carrier as claimed in claim 5, wherein said openings are elongate along the apical line with adjacent ends rounded to facilitate removal of inserted end containers by outward and upward swinging movement thereof and removal of an intermediate inserted container by swinging movement in either direction and upwardly.

7. A carrier as claimed in claim 6, wherein opposite end openings have the outer ends thereof generally perpendicular to the apical line for additional engagement with shoulder means of containers to be associated with the carrier.

8. A carrier as claimed in claim 5, wherein adjacent ends of the said openings present a continuous edge for shoulder means engagement with said edge separated from a longitudinal slit by a frangible web section whereby outward and upward swinging of inserted end containers will break the web section facilitating removal thereof and swinging of an intermediate insert container in either direction and upwardly will break a corresponding web section facilitating removal thereof.

9. A carrier as claimed in claim 5, wherein the carrier is formed of sheet plastic material with the said end portions of the strap segments heat sealed together.

* * * * *